US012214938B2

(12) United States Patent
Obrad

(10) Patent No.: US 12,214,938 B2
(45) Date of Patent: Feb. 4, 2025

(54) VAPOR PLUG RETENTION STRAP

(71) Applicant: Cryoport, Inc., Brentwood, TN (US)

(72) Inventor: Frank Obrad, Fullerton, CA (US)

(73) Assignee: Cryoport, Inc., Brentwood, TN (US)

( * ) Notice: Subject to any disclaimer, the term of this patent is extended or adjusted under 35 U.S.C. 154(b) by 0 days.

(21) Appl. No.: 18/212,017

(22) Filed: Jun. 20, 2023

(65) Prior Publication Data

US 2023/0331443 A1 Oct. 19, 2023

Related U.S. Application Data

(63) Continuation of application No. 17/397,572, filed on Aug. 9, 2021, now Pat. No. 11,713,167, which is a continuation of application No. 16/657,317, filed on Oct. 18, 2019, now Pat. No. 11,097,873.

(51) Int. Cl.
*B65D 45/02* (2006.01)

(52) U.S. Cl.
CPC ..... *B65D 45/02* (2013.01)

(58) Field of Classification Search
CPC .. B65D 45/02; F17C 13/06; F17C 2205/0311; F17C 2221/014; F17C 2223/0161; F17C 2223/033; F17C 2270/0509; F16C 13/06
See application file for complete search history.

(56) References Cited

U.S. PATENT DOCUMENTS 3,365,153 A * 1/1968 Baucom ..... A61J 9/0638 248/102
3,419,198 A 12/1968 Nimrod
4,132,225 A 1/1979 Whattam
4,215,700 A 8/1980 Crouther et al.
4,457,458 A 7/1984 Heinol
4,533,058 A 8/1985 Uhlig
4,583,652 A 4/1986 Goldberg
4,874,102 A 10/1989 Jessop et al.
5,090,583 A 2/1992 Hoffman et al.
5,147,362 A * 9/1992 Goble ..... A61F 2/0811 606/151

(Continued)

FOREIGN PATENT DOCUMENTS

AU 2003204488 A1 1/2004
CN 201268438 Y 7/2009

(Continued)

OTHER PUBLICATIONS

PCT; International Search Report & Written Opinion dated Feb. 1, 2021 in PCT Application No. US2020/06083.

(Continued)

*Primary Examiner* — Kareen K Thomas

(74) *Attorney, Agent, or Firm* — Snell & Wilmer L.L.P.

(57) ABSTRACT

Method, system, apparatus, and/or device to secure the vapor plug within the dewar. The vapor plug retention strap includes a first connector, a second connector and a main body. The second connector is configured to couple with the first connector. The main body is coupled in between the first connector and the second connector. The main body has a receptacle formed within that is configured to receive a neck of a vapor plug of a dewar and retain the neck of the vapor plug to secure the vapor plug within the dewar.

20 Claims, 6 Drawing Sheets

(56) References Cited

U.S. PATENT DOCUMENTS

| | | | | |
|---|---|---|---|---|
| 5,159,780 | A * | 11/1992 | Molthen | A01G 9/12 47/45 |
| 5,167,354 | A * | 12/1992 | Cohanfard | A47G 19/2266 215/229 |
| 5,203,831 | A | 4/1993 | Lind et al. | |
| 5,271,519 | A | 12/1993 | Adams et al. | |
| 5,402,971 | A | 4/1995 | Bower | |
| 5,407,110 | A * | 4/1995 | Marsh, Jr. | A45F 5/00 294/149 |
| 5,499,736 | A | 3/1996 | Kohl | |
| 5,657,792 | A | 8/1997 | Prest | |
| 6,227,399 | B1 | 5/2001 | Angus | |
| 6,460,560 | B1 | 10/2002 | Weinheimer et al. | |
| 6,675,998 | B2 | 1/2004 | Forsman et al. | |
| 6,814,639 | B1 | 11/2004 | Peterson | |
| 8,245,870 | B2 | 8/2012 | McKinney et al. | |
| 8,584,695 | B2 | 11/2013 | Lau | |
| 11,097,873 | B2 | 8/2021 | Obrad | |
| 11,713,167 | B2 | 8/2023 | Obrad | |
| 2002/0166326 | A1 | 11/2002 | Giesy et al. | |
| 2004/0163707 | A1 | 8/2004 | Reeb et al. | |
| 2005/0205436 | A1 | 9/2005 | Erickson | |
| 2007/0022761 | A1 | 2/2007 | Schlenga et al. | |
| 2008/0223449 | A1 | 9/2008 | Culp et al. | |
| 2009/0065559 | A1 | 3/2009 | Parkes | |
| 2012/0090699 | A1 * | 4/2012 | Lau | F16K 15/202 137/231 |
| 2017/0023142 | A1 | 1/2017 | Retz et al. | |
| 2018/0042371 | A1 | 2/2018 | Dijulio | |
| 2021/0114780 | A1 | 4/2021 | Obrad | |
| 2021/0362915 | A1 | 11/2021 | Obrad | |

FOREIGN PATENT DOCUMENTS

| | | | |
|---|---|---|---|
| CN | 204297305 | U | 4/2015 |
| CN | 206782424 | U | 12/2017 |
| CN | 210259456 | U | 4/2020 |
| JP | 2007131343 | A | 5/2007 |
| KR | 200244806 | Y1 | 10/2001 |
| KR | 2012004413 | U | 1/2012 |
| KR | 20120004413 | A | 1/2012 |
| WO | 199402374 | A1 | 2/1994 |

OTHER PUBLICATIONS

PCT; International Preliminary Report on Patentability (IPRP) dated Apr. 19, 2022 in Application No. PCT/US2020/056083.

UK Exam report dated Jan. 24, 2023 in Application No. 2206280.6.

USPTO; Non-Final Office Action dated Oct. 25, 2022 in U.S. Appl. No. 17/397,572.

USPTO; Non-Final Office Action dated Dec. 7, 2020 in U.S. Appl. No. 16/657,317.

CNIPA; Notice of Grant of Patent Right for Invention dated May 19, 2023 for Application No. 202080072779.1.

EP; Extended Search Report dated Oct. 18, 2023 in Application No. 20876356.5.

JP: First Examination Report dated Nov. 17, 2023 in Application Serial No. 2022522888.

IPO; Examination Report under Section 18(3) dated Oct. 13, 2023 for Application No. GB2206280.6.

IPOS; Written Opinion dated Oct. 2, 2023 for Application No. 11202203530Y.

SG; Second Examination Report dated May 24, 2024 in Application Serial No. 11202203530.

UK; Notice of Intent to Grant dated Jan. 2, 2024 in Application No. 2206280.6.

JP; Notice of Allowance dated Mar. 1, 2024 in Application No. 2022-522888.

* cited by examiner

VAPOR PLUG RETENTION STRAP

CROSS-REFERENCE TO RELATED APPLICATION

This application is a continuation of, and claims priority to and the benefit of U.S. patent application Ser. No. 17/397,572, entitled "VAPOR PLUG RETENTION STRAP," filed on Aug. 9, 2021, which is a continuation of, and claims priority to and the benefit of U.S. patent application Ser. No. 16/657,317, entitled "VAPOR PLUG RETENTION STRAP," filed on Oct. 18, 2019, the entirety of each of which is hereby incorporated by reference herein.

BACKGROUND

1. Field

This specification relates to a system, device or apparatus to assist in retaining the lid or vapor plug of a dry vapor shipper, such as a dewar, during transport.

2. Description of the Related Art

Dry vapor shippers, such as dewar or other vessel, vent liquid nitrogen to prevent the buildup of pressure inside of the vessel, which could cause the dry vapor shipper to explode. The dry vapor shipper has a vapor plug, cork, lid or other cap that rides freely within the neck of the dry vapor shipper. The vapor plug is designed to allow gases to escape from the dry vapor shipper. Since the lid, cap or vapor plug rides freely within the neck of the dry vapor shipper, there is no seal between the vapor plug and the neck of the dry vapor shipper to allow the gas to freely escape. When the vapor plug rides freely, a sudden jarring or movement of the dry vapor shipper may cause the vapor plug to dislodge from the neck of the dry vapor shipper. Thus, if the vapor plug is not retained within the dry vapor shipper and the vapor plug is dislodged during transit, thermal transmission will increase within the dry vapor shipper and the dry vapor shipper warms more quickly and/or the contents of the dry vapor shipper may spill out.

Traditionally, the dry vapor shippers do not have a retaining device that keeps the vapor plug in the neck of the dry vapor shipper during transit. And so, when there are sudden movements during transit, the vapor plug may be dislodged from within the neck of the dry vapor shipper. This results in thermal transmission and increases the temperature within dry vapor shipper causing the contents to warm more quickly.

Accordingly, there is a need for a system, device or apparatus to retain the vapor plug with the dry vapor shipper.

SUMMARY

In general, one aspect of the subject matter described in this specification is embodied in a vapor plug retention strap. The vapor plug retention strap plugs, secures and/or otherwise retains the vapor plug within a neck tube of a dewar during transport of the dewar to prevent the vapor plug from jarring out or otherwise dislodging from the neck tube of the dewar.

The vapor plug retention strap includes a first connector, a second connector and a main body. The second connector is configured to couple with the first connector. The main body is coupled in between the first connector and the second connector. The main body has a receptacle formed within that is configured to receive a neck of a vapor plug of a dewar and retain the neck of the vapor plug to secure the vapor plug within the dewar.

These and other embodiments may optionally include one or more of the following features. The first connector and the second connector may each have a distal end positioned away from the main body and a proximal end positioned or coupled to the main body. The distal end of the first connector may be wrapped and connected to the distal end of the second connector over a top of the vapor plug to retain the vapor plug. The main body may have a first curved portion and a second curved portion. The first connector and the second connector may be positioned in between the first curved portion and the second curved portion on opposite sides.

The receptacle may have an inner portion. The inner portion may include an inner edge and one or more inlets formed on the inner edge. The one or more inlets may be configured to form multiple sections within the inner portion that flex, move or adjust to movement of the neck of the vapor plug.

The first connector may be a buckle and a first strap and the second connector may be a latch and a second strap. The latch may be inserted into the buckle to couple the second connector and the first connector. The first strap may couple the buckle and the main body and the first strap may have multiple slots positioned along the first strap between the buckle and the main body. The latch may be inserted into different slots of the multiple slots to adjust a length of the vapor plug retention strap.

In another aspect, the subject matter is embodied in a vapor plug retention strap. The vapor plug retention strap includes a buckle with a first strap. The vapor plug retention strap includes a latch with a second strap. The latch is configured to be inserted into the buckle to lock or secure the latch with the buckle. The vapor plug retention strap includes a body portion. The body portion is coupled to the first strap and the second strap. The body portion has a receptacle formed within that is configured to receive a neck of a vapor plug of a dewar. The receptacle is configured to retain the neck of the vapor plug within the receptacle and secure the body portion around the neck of the vapor plug.

In another aspect, the subject matter is embodied in a vapor plug retention strap that includes a first connector, a second connector and a body. The second connector is configured to couple with the first connector over a top of a vapor plug. The body is coupled in between the first connector and the second connector. The body has a collar formed within that is configured to receive a neck of the vapor plug and retain the neck of the vapor plug within the dewar when the first connector and the second connector are coupled. The collar is configured to secure the body around the neck of the vapor plug.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale and may be exaggerated to better illustrate the important features of the present invention.

DETAILED DESCRIPTION

Disclosed herein are systems, apparatuses and devices for transporting and storing a liquid or gas, such as liquid nitrogen. The system, apparatus or device may be a vapor plug retention strap that locks, holds or otherwise configured to retain the vapor plug around the neck of the dewar. Particular embodiments of the subject matter described in this specification may be implemented to realize one or more of the following advantages.

Typically, the vapor plug rides freely in the neck of the dry vapor shipper, such as a dewar. The vapor plug rides freely to allow gases within the dry vapor shipper to escape to prevent a buildup of pressure inside the dry vapor shipper. There is usually no device that secures the vapor plug to the neck of the dewar, and so, when the dewar is transported, the vapor plug may rise out of the neck of the dewar or otherwise be jarred out of the neck of the dewar. This may result in thermal transmission to the dewar, which causes the dewar to warm more quickly. Thus, by securing the vapor plug to the neck of the dewar with a vapor plug retention strap, the vapor plug is secured to the neck of the dewar and the contents of the dewar are prevented from spilling out and/or the amount of thermal transmission to the dewar is reduced, which allows cryogenic temperatures to be maintained for a longer period of time.

Other benefits and advantages of the vapor plug retention strap include the capability to secure different sizes of vapor plugs to different sizes of dewars. For example, the length of the connectors that secure the top of the vapor plug may be adjustable to accommodate vapor plugs having lids of different diameters. In another example, an inner portion of a body of the vapor plug retention strap may be flexible to accommodate vapor plugs having necks of different diameters and/or the insertion of the vapor plug. Additionally, the vapor plug retention strap may be made of a high-density polyethylene (HDPE) that withstands cryogenic temperatures and is cut from a sheet to provide a very economical solution to secure the vapor plug with the neck of the dewar. Moreover, the vapor plug retention strap is easily replaceable due to the use of the cost-effective materials, such as HDPE. This allows the vapor plug retention strap to be thrown away after a single-use.

Figure 1:
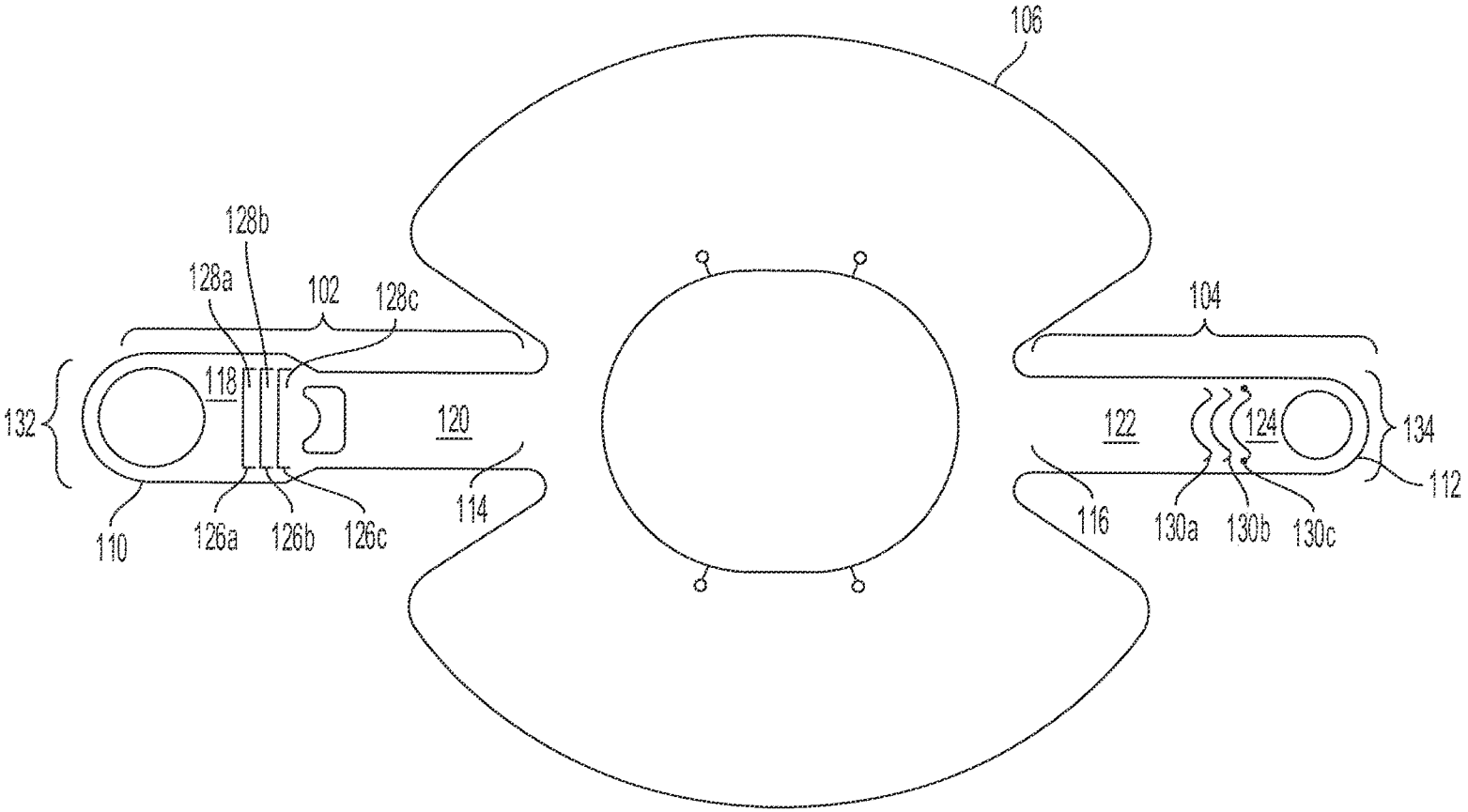
FIG. 1 shows an example vapor plug retention strap according to an aspect of the invention.
Figure 4:
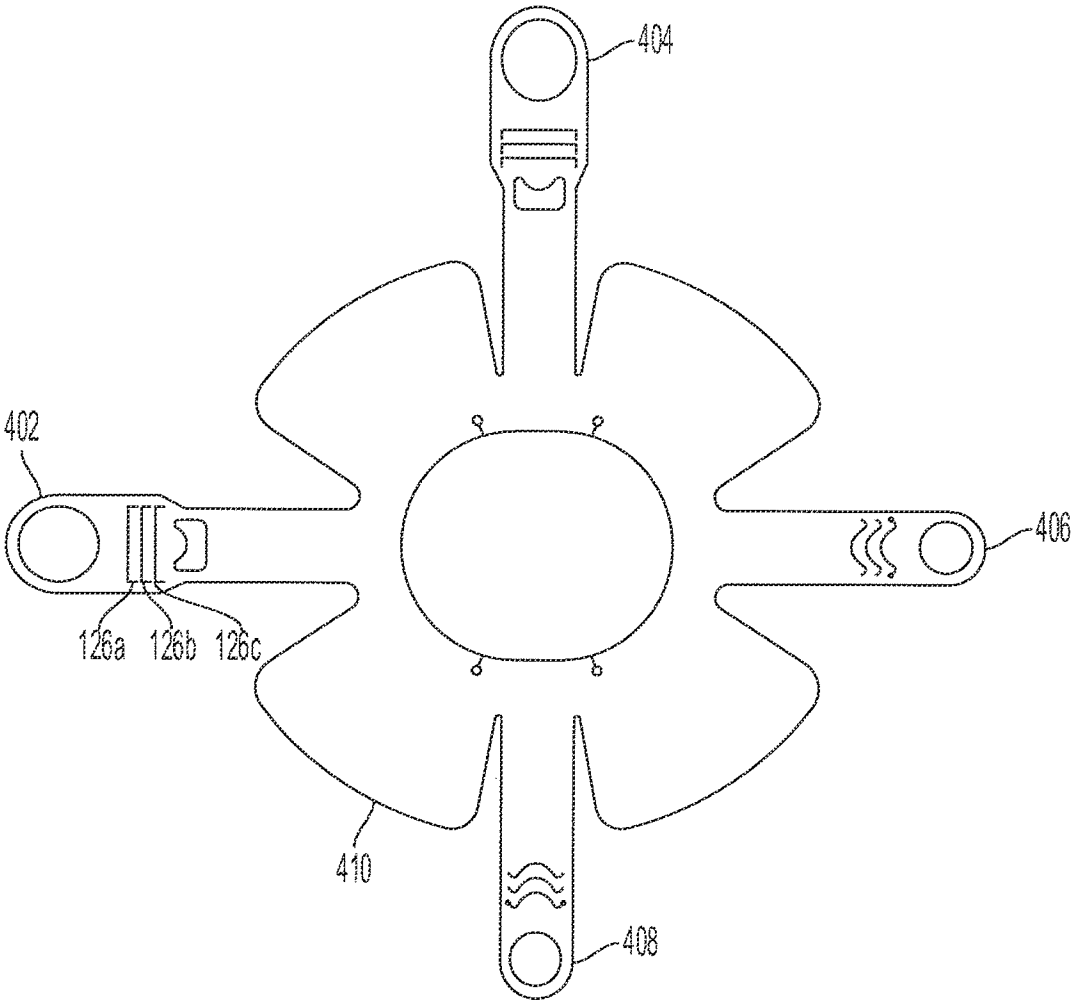
FIG. 4 shows an example vapor plug retention strap with multiple connectors according to an aspect of the invention.

FIG. 1 shows a vapor plug retention apparatus or device, such as a vapor plug retention strap 100. The vapor plug retention strap 100 has one or more connectors, such as a first connector 102 and/or a second connector 104, and a main body 106. The vapor plug retention strap 100 may have any number of connectors, such as the two connectors 102, 104, as shown in FIG. 1, or the four connectors 402, 404, 406, 408, as shown in FIG. 4.

The one or more connectors 102, 104 and the main body 106 may be integrally formed and may be made from a High-Density Polyethylene (HDPE) material that is flexible and is made to withstand cryogenic temperatures. The one or more connectors 102, 104 and the main body 106 may be cut from a sheet of HDPE material using a flat pattern.

Figure 3A:
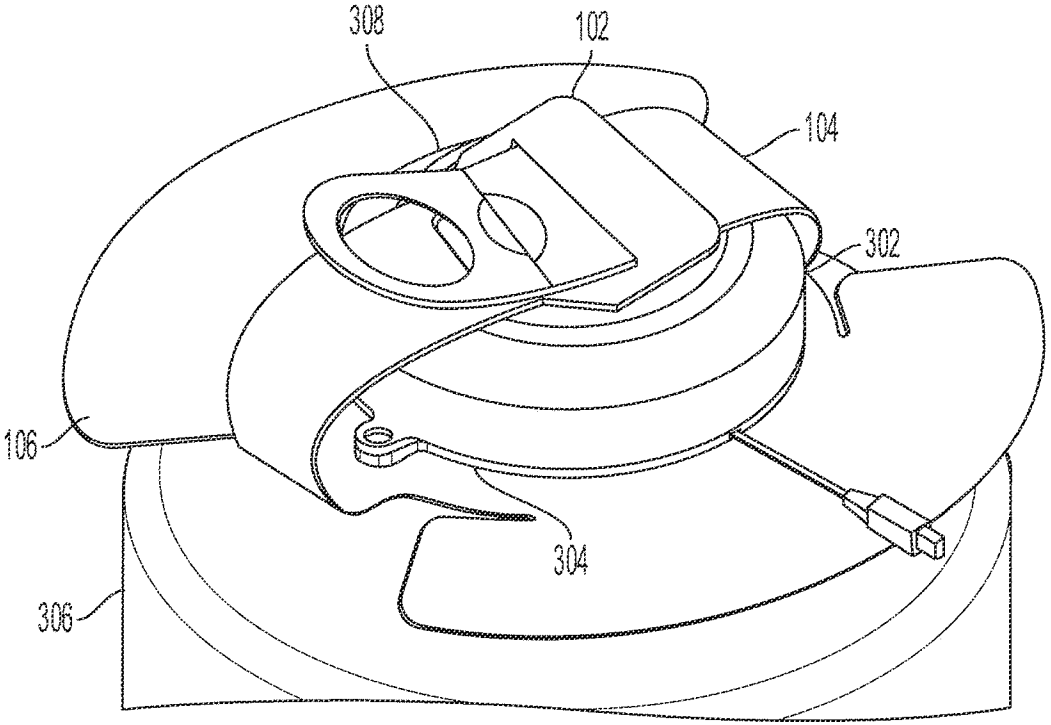
FIG. 3A shows the vapor plug secured within the dewar using the vapor plug retention strap of FIG. 1 according to an aspect of the invention.

The first connector 102 may be positioned on, formed on or otherwise coupled to one side of the main body 106 and the second connector 104 may be positioned on, formed on or otherwise coupled to the opposite side of the main body 106. When there are multiple connectors, each connector may be positioned equidistant from an adjacent connector and/or opposite and directly aligned with another connector of the multiple connectors. Each connector may connect or couple to the corresponding opposite connector when wrapped over the top of the lid of the vapor plug, as shown in FIG. 3A for example.

The first connector 102 and the second connector 104 each have a distal end 110, 112, respectively, and a proximal end 114, 116, respectively. The distal end 110 of the first connector 102 and the distal end 112 of the second connector 104 are outward and away from the main body 106. The proximal end 114 of the first connector 102 and the proximal end 116 of the second connector 104 are in proximity to and/or coupled to the main body 106. The proximal ends 114, 116 may be integrally formed with the main body 106 or may be connected, fastened or otherwise coupled to the main body 106.

The first connector 102 may include a first connector strap portion ("first connector strap") 120 and/or a buckle portion ("buckle") 118. The first connector strap 120 connects the buckle 118 with the main body 106. The second connector 104 may include a second connector strap portion ("second connector strap") 122 and/or a latch portion ("latch") 124. The second connector strap 122 connects the latch 124 with the main body 106. The length of the first connector strap 120 and the length of the second connector strap 122 may be the same or different to accommodate the various size requirements of the dewar. The length of the first connector strap 120 and the length of the second connector strap 122 may be of the same length and the latch 124 may be inserted into the buckle 118 to lock or secure the first connector 102 with the second connector 104 over the center of the lid of the vapor plug.

The buckle 118 may have a large handle 132 and the latch 124 may have a small handle 134 to allow a user to grasp the buckle 118 and the latch 124, respectively. The large handle 132 and the small handle 134 may be used to guide or insert the second connector 104 into one or more interlocking slots 126*a-c* of the first connector 102 to interlock the first connector 102 and the second connector 104.

The first connector 102 may have one or more interlocking slots 126*a-c* and the second connector 104 may have one or more interlocking flaps 130*a-c*. The one or more interlocking slots 126*a-c* may be positioned anywhere along the first connector 102, e.g., on the buckle 118 or the first connector strap 120. The one or more interlocking flaps 130*a-c* may be positioned anywhere along the second connector 104, e.g., on the latch 124 or the second connector strap 122. The one or more interlocking slots 126*a-c* may be ribbed or curved-shaped to form a curve-shaped protruding portion 128*a-c*. This allows the second connector 104 to lock with the first connector 102 when the second connector 104 is inserted into the one of the one of more interlocking slots 126*a-c* of the first connector 102.

When first connector 102 and the second connector 104 are wrapped over the top of the lid of the vapor plug and the second connector 104 is inserted into one of the one or more interlocking slots 126*a-c* of the first connector 102, a tension or force pulls, moves or aligns one of the one or more interlocking flaps 130*a-c* with the curve-shaped protruding portion 128*a-c* corresponding to the slot in which the second connector 104 was inserted into. The interlocking flap 130*a-c* interlocks with the curve-shaped protruding portion 128*a-c*. This locks the first connector 102 with the second connector 104.

Figure 5:
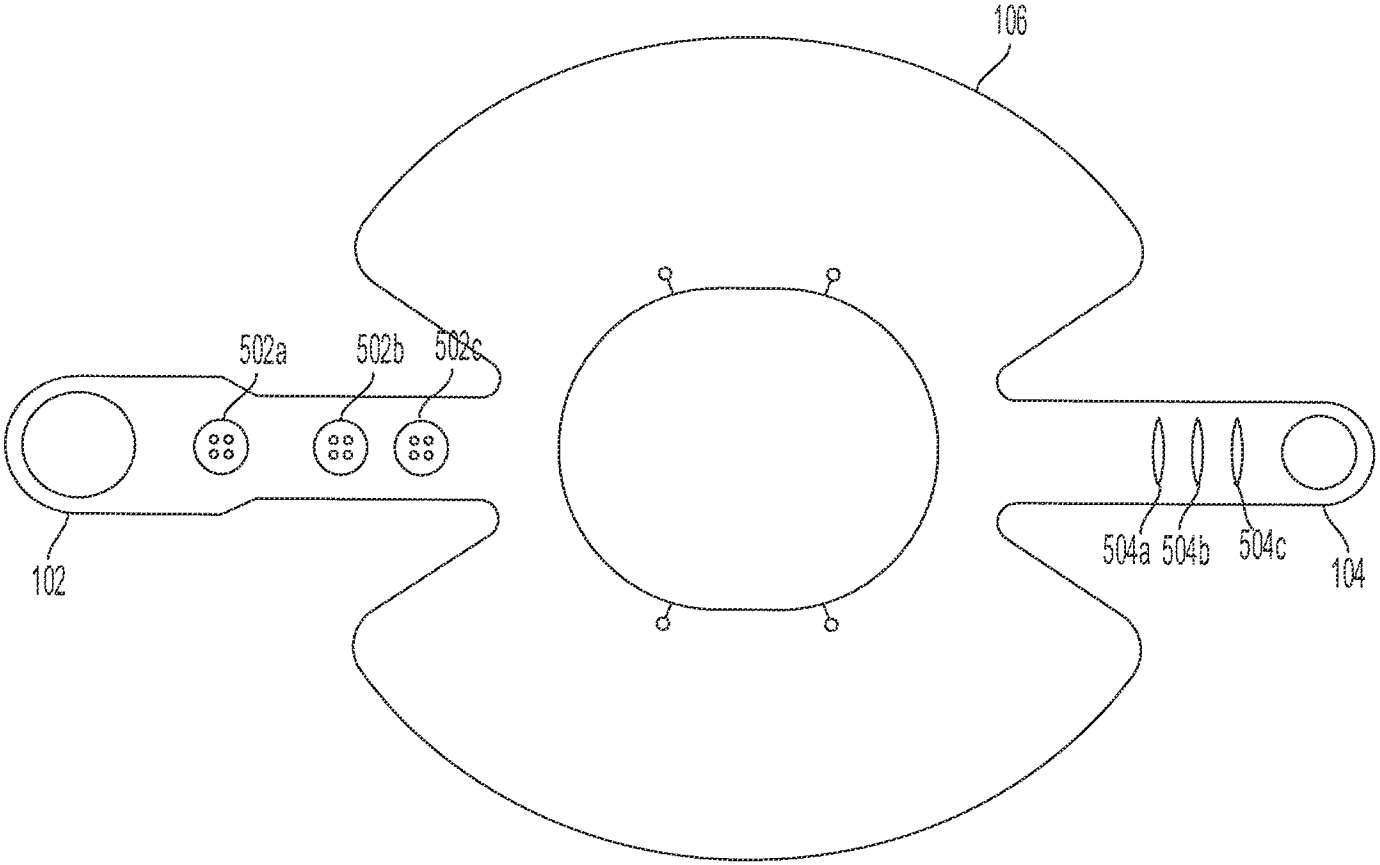
FIG. 5 shows the vapor plug retention strap of FIG. 1 with connectors having a different fastening device according to an aspect of the invention.

In some implementations, the first connector 102 and the second connector 104 use a button, clasp, stud or other fastener to couple the second connector 104 and the first connector 102, as shown in FIG. 5 for example. For example, one or more buttons 502*a-c* on the first connector 102 may be inserted into a corresponding slot 504*a-c* or clasp onto or fasten with another portion of the button 502*a-c* positioned on the second connector 104.

Figure 2:
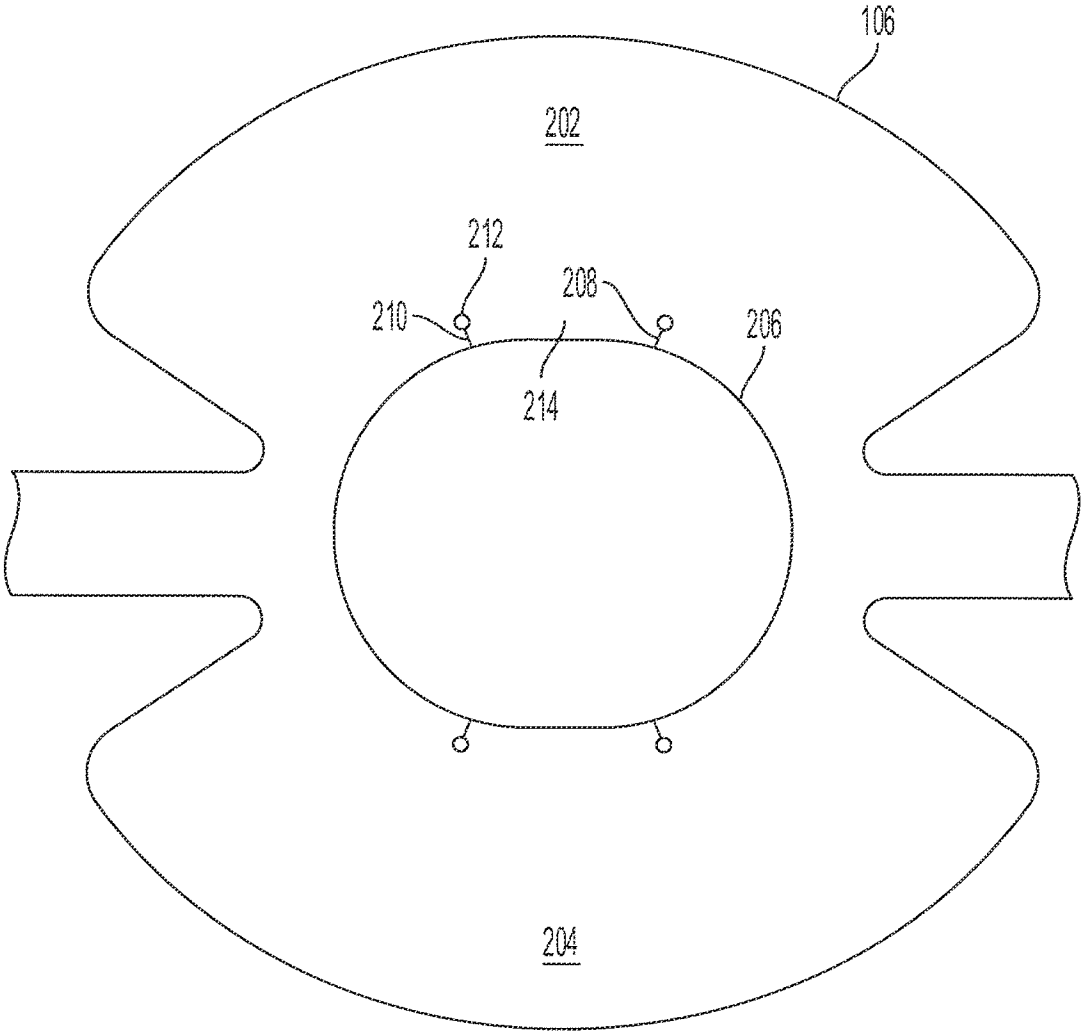
FIG. 2 shows a close-up perspective view of the one or more inlets of the vapor plug retention strap of FIG. 1 according to an aspect of the invention.

The vapor plug retention strap 100 includes the main body 106. The main body 106 may be positioned between the first connector 102 and the second connector 104. The main body 106 may be formed into any shape and/or size. FIG. 2 shows a close-up perspective view of the main body 106. The main body 106 may have a top portion 202, a bottom portion 204 and a collar 206 or other receptacle. The top portion 202 and the bottom portion 204 may be two semi-circle or curve shaped portions ("curve shaped portions").

The two portions 202-*b* may be made from HDPE to resist cryogenic temperatures and be flexible. When the top portion 202 and the bottom portion 204 are curve shaped portions and the neck of the vapor plug is inserted into the collar 206, the top portions 202 and/or the bottom portion 204 may flex. The two portions 202-*b* may redirect any gas that escapes away from the dewar. Moreover, the curve shaped portions, in combination with a foam collar in a package, may prevent movement of a dewar within the packaging during transport. The curve shaped portions may stabilize the dewar within the packaging by transferring any forces from the dewar due to the movement to the foam collar.

The collar 206 may be formed within the body 106 and positioned in between the first connector 102, the second connector 104, and the top and bottom portions 202, 204. For example, the top portion 202 is positioned opposite the bottom portion 204. In between the two portions 202, 204, on one side of the main body 106, is the first connector 102, and in between the two portions 202, 204, on the other side of the main body 106 and opposite the first connector 102, is the second connector 104.

The collar 206 may have an inner portion with an inner edge 216 around the receptacle area that receives the neck of the vapor plug. The collar may be shaped as a circle, oval, ellipse or other polygonal shape and may have a diameter that is greater than a diameter of the neck of the dewar. The collar 206 receives the neck of the vapor plug of the dewar and retains the neck of the vapor plug within the collar 206. For example, the inner edge 216 may interlock with one or more grooves or channels of the neck of the vapor plug of the dewar to retain the neck of the vapor plug within the collar 206. By interlocking with one or more grooves, the inner edge 216 locks or inserts into the one or more grooves and secure the main body 106 of the vapor plug retention strap 100 around the neck of the vapor plug. The inner portion may have one or more inlets 208. The one or more inlets 208 may be formed along the inner edge 216 of the collar 206.

An inlet 208 may have a slit 210 with a through-hole 212. The slit 210 may be formed from the inner edge 216 of the collar 206 and lead to the through-hole 212. By having multiple inlets 208 along the inner edge 216 of the collar 206, one or more edge portions 214 are formed. The one or more edge portions 214 may be flexible flaps that adjust to the neck of the vapor plug so that the neck of the vapor plug remains retained within the collar 206 even when the vapor plug is jarred, dislodged or otherwise uncoupled from the neck of the dewar due to movement while transporting the dewar, for example. The one or more edge portions 214 may adjust to the size or diameter of the neck of the vapor plug as the vapor plug is inserted into collar 206. As the neck of the vapor plug is inserted into the collar 206, the inner portion of the vapor plug may expand because the one or more edge portions 214 are flexible. Moreover, the through-hole 212 may prevent tearing of the vapor plug retention strap 100 when the neck of the vapor plug is inserted into the collar 206.

Figure 3B:
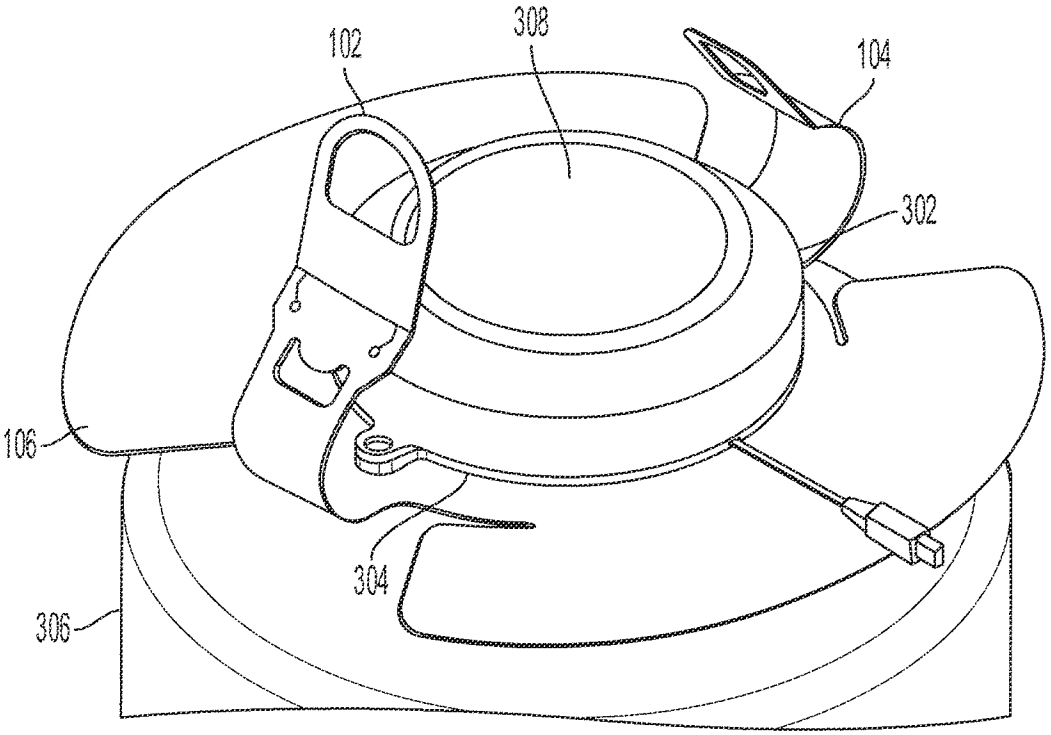
FIG. 3B shows the vapor plug unsecured within the dewar according to an aspect of the invention.

FIG. 3A shows the first connector 102 and the second connector 104 connected, fastened or otherwise coupled to the secure the vapor plug 302 within the dewar 306. The collar 206 receives and surrounds the neck 304 of the vapor plug 302 when the vapor plug 302 is inserted into the collar 206 of the vapor plug retention strap 100. The first connector 102 and the second connector 104 may wrap around the outer circumference of and over the top of the lid 308 of the vapor plug 302. The first connector 102 and the second connector 104 couple, connect or otherwise fasten together to interconnect over the top of the lid 308. This secures the vapor plug 302 within the dewar 306 and prevents the vapor plug 302 from separating, uncoupling or otherwise disengaging from the dewar 306. FIG. 3B shows the first connector 102 and the second connector 104 unconnected, unfastened or otherwise decoupled above the top of the vapor plug 302.

FIG. 4 shows a vapor plug retention strap 400 with multiple connectors, such as a first connector 402, a second connector 404, a third connector 406 and a fourth connector 408. The vapor plug retention strap 400, similarly, retains the vapor plug within the dewar but provides for more securing mechanisms than the vapor plug retention strap 100. Each of the multiple connectors may be connected to, formed with or otherwise coupled to the main body 106. The multiple connectors may be positioned equidistant along a perimeter of the portions 202-*b* of the main body 106. The multiple connectors may be equidistance to balance any force equally across the lid of the vapor plug of the dewar when interconnected. Each connector may be adjacent to two other connector and opposite a third connector. For example, the first connector 402 may be positioned adjacent to the second connector 404 and fourth connector 408 but opposite the third connector 406. The second connector 404 may be positioned adjacent to the first connector 402 and third connector 406 but opposite the fourth connector 404.

Each connector connects to, interconnects with or otherwise couples to a corresponding connector. For example, the first connector 402 may couple with the third connector 406 and the second connector 404 may couple with the fourth connector 408. The first connector 402 and the second connector 404 may have one or more interlocking slots 126*a-c*, slits, buttons or another fastener where the third connector 406 and the fourth connector 408, respectively, are inserted, connected, fastened or otherwise coupled. In some implementations, the first connector 402 and the third connector 404 may have a similar strap as the first connector strap 120 and buckle 118 as the first connector 102 and the second connector 404 and the fourth connector 408 may have a similar strap as the second connector strap 122 and latch 124 as the second connector 104.

Exemplary embodiments of the methods/systems have been disclosed in an illustrative style. Accordingly, the terminology employed throughout should be read in a nonlimiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A vapor plug retention strap, comprising:

a first connector;

a second connector configured to couple with the first connector; and a main body, wherein the first connector and the second connector each have a distal end positioned away from the main body and a proximal end coupled to the main body, wherein the first connector is connectable to the second connector over a top of a vapor plug, and wherein the first connector and the second connector each have a distal end positioned away from the main body and a proximal end positioned or coupled to the main body, wherein the distal end of the first connector is wrapped and connected to the distal end of the second connector over a top of the vapor plug.

2. The vapor plug retention strap of claim 1, wherein the main body has a receptacle, a first curved portion, and a second curved portion.

3. The vapor plug retention strap of claim 2, wherein the first curved portion and the second curved portion each have a portion partially contacting the receptacle.

4. The vapor plug retention strap of claim 2, wherein the first curved portion and the second curved portion radially surround the receptacle.

5. The vapor plug retention strap of claim 2, wherein the first curved portion and the second curved portion partially surround the receptacle.

6. The vapor plug retention strap of claim 1, wherein the main body has a first curved portion and a second curved portion, wherein the first connector and the second connector are positioned in between the first curved portion and the second curved portion on opposite sides.

7. A vapor plug retention strap, comprising:

a connector; and a main body having a receptacle, wherein the receptacle has an inner portion defining a collar to receive a neck of a vapor plug, the inner portion including an inner edge and one or more inlets formed on the inner edge, wherein the one or more inlets each comprise a slit and a through-hole, wherein the slit is formed from the inner edge of the collar and leads to the through-hole, and wherein the one or more inlets are configured to form a plurality of sections within the inner portion that flex, move, or adjust to movement of a neck of the vapor plug.

8. The vapor plug retention strap of claim 7, wherein the connector has a buckle and a first strap.

9. The vapor plug retention strap of claim 8, further comprising a second connector configured to couple with the first connector.

10. The vapor plug retention strap of claim 9, wherein the second connector has a latch and a second strap.

11. A vapor plug retention strap, comprising:

a strap, wherein the strap has a plurality of slots;

a latch configured to be inserted into different slots of the plurality of slots to adjust a length of the vapor plug retention strap; and a body portion coupled to the strap and having a receptacle formed within, the receptacle having a neck of a dewar received into the receptacle so that the receptacle encircles the neck and connects the body portion to the neck, wherein the strap and the latch are coupled to the body portion and connect over a top of an opening of the neck to retain a vapor plug inside the neck.

12. The vapor plug retention strap of claim 11, wherein the body portion has a first curved portion and a second curved portion.

13. The vapor plug of claim 12, wherein the strap has a buckle, the buckle and the latch being positioned in between the first curved portion and the second curved portion on opposite sides.

14. The vapor plug retention strap of claim 12, wherein the first curved portion and the second curved portion each have an edge partially contacting the receptacle.

15. The vapor plug retention strap of claim 14, wherein the first curved portion and the second curved portion radially surround the receptacle.

16. The vapor plug retention strap of claim 15, wherein the first curved portion and the second curved portion partially surround the receptacle.

17. The vapor plug retention strap of claim 11, wherein the receptacle has an inner portion, the inner portion including an inner edge and one or more inlets formed on the inner edge, the one or more inlets being configured to form a plurality of sections within the inner portion that flex, move, or adjust to movement of a neck of the vapor plug.

18. The vapor plug retention strap of claim 11, further comprising a buckle attached to the strap, the buckle to lock or secure the latch with the buckle.

19. The vapor plug retention strap of claim 11, wherein the buckle and the latch are positioned away from the body portion and the strap is coupled to the body portion.

20. The vapor plug retention strap of claim 11, wherein the latch is on a further strap, wherein the strap and the further strap are coupled to the body portion.

* * * * *